US008421596B2

(12) United States Patent
Choi et al.

(10) Patent No.: US 8,421,596 B2
(45) Date of Patent: Apr. 16, 2013

(54) DOOR LOCK DEVICE

(76) Inventors: Seung Kuk Choi, Seoul (KR); Myung Wha Nam, Seoul (KR)

( * ) Notice: Subject to any disclaimer, the term of this patent is extended or adjusted under 35 U.S.C. 154(b) by 390 days.

(21) Appl. No.: 12/607,250

(22) Filed: Oct. 28, 2009

(65) Prior Publication Data

US 2011/0084802 A1 Apr. 14, 2011

(30) Foreign Application Priority Data

Oct. 12, 2009 (KR) ..... 10-2009-0096784

(51) Int. Cl.
*G08B 5/22* (2006.01)
*E05B 17/10* (2006.01)

(52) U.S. Cl.
USPC ..... 340/6.1; 340/426.22; 340/426.24; 340/426.25; 340/426.26; 340/426.28; 362/100; 362/641

(58) Field of Classification Search ..... 340/6.1, 340/384.1–384.4, 426.22–426.28, 464, 5.51; 362/100, 641
See application file for complete search history.

(56) References Cited

U.S. PATENT DOCUMENTS 4,745,527 A * 5/1988 Belverio et al. ..... 362/100
4,821,542 A * 4/1989 Rosenthal ..... 70/454
5,398,175 A * 3/1995 Pea ..... 362/100
6,273,579 B1 * 8/2001 Holloway ..... 362/100
6,439,732 B1 * 8/2002 Weisbach et al. ..... 362/100
6,447,139 B1 * 9/2002 Wilkes ..... 362/100
6,522,078 B1 * 2/2003 Okamoto et al. ..... 315/149
6,655,811 B2 * 12/2003 Weisbach et al. ..... 362/100
6,729,740 B1 * 5/2004 Gazard ..... 362/100
7,832,887 B2 * 11/2010 Battle ..... 362/100
7,866,195 B2 * 1/2011 Levine ..... 70/432
7,878,672 B2 * 2/2011 Yang ..... 362/100
2005/0006528 A1 * 1/2005 Movsesian et al. ..... 244/129.5
2005/0248931 A1 * 11/2005 Alvarez ..... 362/100
2006/0203471 A1 * 9/2006 Hodges et al. ..... 362/100
2006/0209550 A1 * 9/2006 Fabiao ..... 362/501
2007/0115095 A1 * 5/2007 Eguchi ..... 340/5.61
2008/0204258 A1 * 8/2008 Dayton et al. ..... 340/600
2009/0180277 A1 * 7/2009 Falce ..... 362/100

* cited by examiner

*Primary Examiner* — Albert Wong
*Assistant Examiner* — Peter Mehravar
(74) *Attorney, Agent, or Firm* — Ladas & Parry LLP

(57) ABSTRACT

Provided is a door lock device which is installed on a door, to enable people to facilitate to find out location of the door at dark or night and enable the door to be illuminated with a certain brightness so as to be easily viewed at indoor and outdoor sides when indoor and/or outdoor illumination is low, that is, at dark. As a result, the door lock device enables people to easily find out an entrance gate under the fire and other emergency situations. As well, people do not need to find out a particular position or particular article gropingly even in a dark indoor or outdoor. Accordingly, people may not be easily hurt. In addition, since indoor and outdoor places can be illuminated at a certain brightness, the door lock device can indicate that people exist in a warehouse or on a roof of a building even in the case that a warehouse door lock device or a roof entrance door lock device has been automatically locked.

3 Claims, 8 Drawing Sheets

DOOR LOCK DEVICE

BACKGROUND OF THE INVENTION

1. Field of the Invention

The present invention relates to a door lock device, and more particularly, to a door lock device which is installed on a door, to thus enable people to facilitate to find out location of the door or a particular position of an indoor place, at dark or night, and enable the door to be illuminated with a certain brightness so as to be easily viewed at indoor and outdoor sides when indoor and/or outdoor illumination is low, that is, at dark, to thereby make people easily find out a key board and/or a key insertion hole of a door key lock of the door lock device.

2. Description of the Related Art

Widely-used conventional door lock devices are installed on doors and have only a function of making unauthorized people not easily unlock the door without a key from outdoors when the door lock devices have been locked.

However, the conventional door lock devices have no illumination units. Thus, in the case that a person is awaken out of a bed during sleep at night, it is too dark for him or her to easily identify location of a particular place or article such as a door. Accordingly, since he or she should turn on a lighting unit or illumination unit, there may cause a problem of making other people at sleep feel uncomfortable.

In addition, in the case that a person who is awaken from sleep finds a particular place or article such as a bathroom or kitchen or its door, gropingly at dark, under the circumstances where no lights are lightened up, in order to prevent other people who sleep around from being inconvenienced, he or she may be hit or hurted by a wall or door. Further, in the case that people enter a warehouse or a roof of a building, the conventional lock device is automatically locked and thus an entrance gate door is automatically shut, so that the people cannot come out from the warehouse or roof of the building.

In addition, at fires or power outages, people cannot find an emergency entrance gate, in the case of the conventional door lock devices. Further, in the case of the conventional door lock devices which are used for front doors, people cannot identify whether the doors are opened or shut until they touch the door lock devices directly.

SUMMARY OF THE INVENTION

To overcome problems or inconveniences of the conventional art, it is an object of the present invention to provide a door lock device which is installed on a door, to thus enable people to facilitate to find out location of the door or a particular position of an indoor place, at dark or night, and enable the door to be illuminated with a certain brightness so as to be easily viewed at indoor and outdoor sides when indoor and/or outdoor illumination is low, that is, at dark.

It is another object of the present invention to provide a door lock device which can indicate whether or not people exist in a warehouse or a roof of a building.

It is still another object of the present invention to provide a door lock device which can enable people to easily find out a key board and/or a key insertion hole of a door key lock of the door lock device.

It is yet another object of the present invention to provide a door lock device which enables people to easily identify whether a door is opened or shut even if they do not touch the door lock device directly.

To accomplish the above objects of the present invention, according to an aspect of the present invention, there is provided a door lock device comprising:

an outer plate which is installed at the outer side of a door;

an inner plate which is installed at the inner side of the door;

an L-shaped outer handle which is protruded at a certain distance from the outer plate;

a key insertion hole which is installed at a certain interval toward the lower portion from the outer handle of the outer plate; and an L-shaped inner handle which is protruded at a certain distance from the inner plate, wherein the door lock device further comprises:

an illumination detection sensor which is installed on the inner plate to thus detect an indoor illumination;

an infrared detection sensor which is installed on the outer plate so that the key insertion hole can be easily found out at dark or night, to thus detect the infrared radiation from a human body;

a microprocessor which receives an illumination detection signal detected by the illumination detection sensor, and compares the illumination detection signal with reference illumination data which is pre-stored therein, to thereby output an emitting control signal in the case that it is dark, that is, it is judged that the illumination is low, and simultaneously output an emitting control signal in the case that the infrared radiation from a human body is detected by the infrared detection sensor;

a light emitting diode drive which receives the emitting control signal from the microprocessor and supplies a light emitting diode with electric power so that the light emitting diode which is installed in one of the inner and outer handles emits light;

a key board which is installed on the outer plate in order to enable a person to input a password or a password change signal into the microprocessor; and an acoustic output unit which outputs a melody for notifying that the door lock device is locked when the door lock device is locked, or a melody for notifying that the door lock device is unlocked when the door lock device is unlocked and simultaneously alarming that the door lock device is not locked with a short and quick melody when the door lock device is unlocked.

Preferably but not necessarily, the inner and outer handles are made of a transparent or semi-transparent high-intensity synthetic resin through which light from the light emitting diodes can be transmitted.

Preferably but not necessarily, the illumination detection sensor is a photo-cell.

To accomplish the above objects of the present invention, according to another aspect of the present invention, there is provided a door lock device comprising:

an outer plate which is installed at the outer side of a door;

an inner plate which is installed at the inner side of the door;

an L-shaped outer handle which is protruded upwards at a certain distance from the outer plate and is made of a metallic or non-metallic material;

a key insertion hole which is installed at a certain interval toward the lower portion from the outer handle of the outer plate; and an L-shaped inner handle which is protruded at a certain distance from the inner plate and is made of a metallic or non-metallic material;

wherein the door lock device further comprises:

an illumination detection sensor which is installed on the inner plate to thus detect an indoor illumination;

an infrared detection sensor which is installed on the outer plate so that the key insertion hole can be easily found out at dark or night, to thus detect the infrared radiation from a human body;

a microprocessor which receives an illumination detection signal detected by the illumination detection sensor, and compares the illumination detection signal with reference illumination data which is pre-stored therein, to thereby output an emitting control signal in the case that it is dark, that is, it is judged that the illumination is low, and simultaneously output an emitting control signal in the case that the infrared radiation from a human body is detected by the infrared detection sensor;

a light emitting diode drive which receives the emitting control signal from the microprocessor and supplies first and second light emitting diodes with electric power so that one of the first and second light emitting diodes which are respectively installed in the inner and outer plates emits light;

a first light guide which is installed on the rear surface of the outer plate so that light emitted from the first light emitting diode is radiated outdoors; and a second light guide which is installed on the rear surface of the inner plate so that light emitted from the second light emitting diode is radiated indoors.

Preferably but not necessarily, the first and second light guide are made of a transparent or semi-transparent high-intensity synthetic resin or crystal material.

BRIEF DESCRIPTION OF THE DRAWINGS

The above and/or other aspects of the present invention will become apparent and more readily appreciated from the following description of the exemplary embodiments, taken in conjunction with the accompanying drawings in which.

DETAILED DESCRIPTION OF THE INVENTION

Hereinbelow, a door lock device according to a first embodiment of the present invention will be described with reference to the accompanying drawings, that is, FIGS. 1 through 3.

Figure 1:
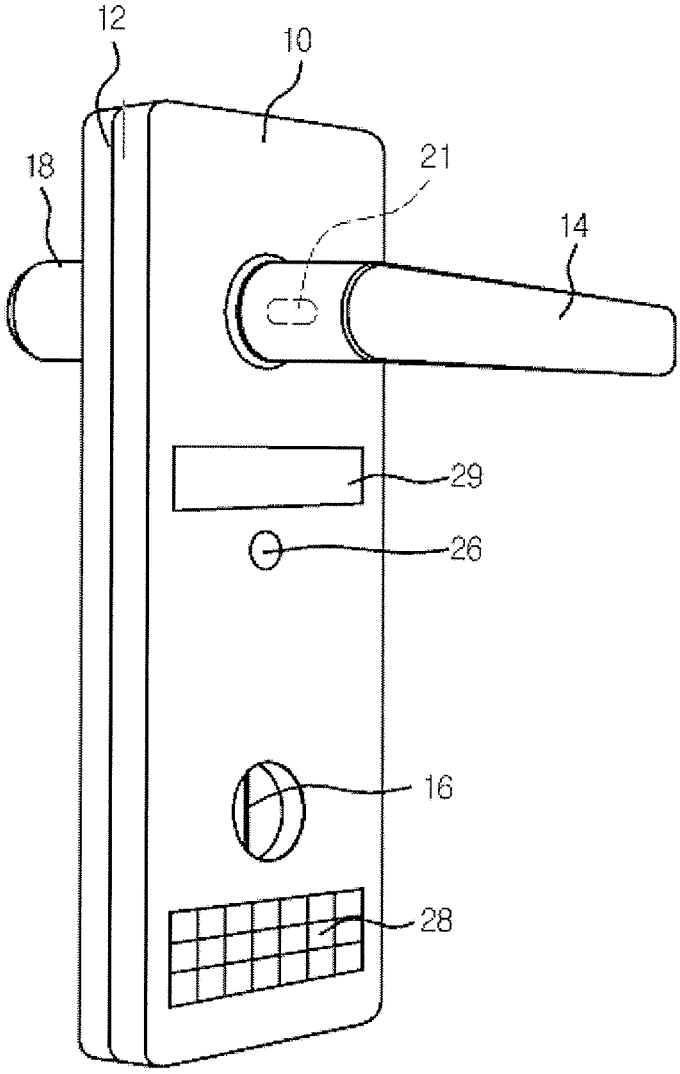
FIG. 1 is a prospective view showing a door lock device when viewed from a front side of the door lock device according to a first embodiment of the present invention.

FIG. 1 is a prospective view showing a door lock device when viewed from a front side of the door lock device according to a first embodiment of the present invention. FIG. 2 is a rear view of FIG. 1. FIG. 3 is a circuit diagram schematically showing a circuit which operates the door lock device according to the first embodiment of the present invention.

Figure 2:
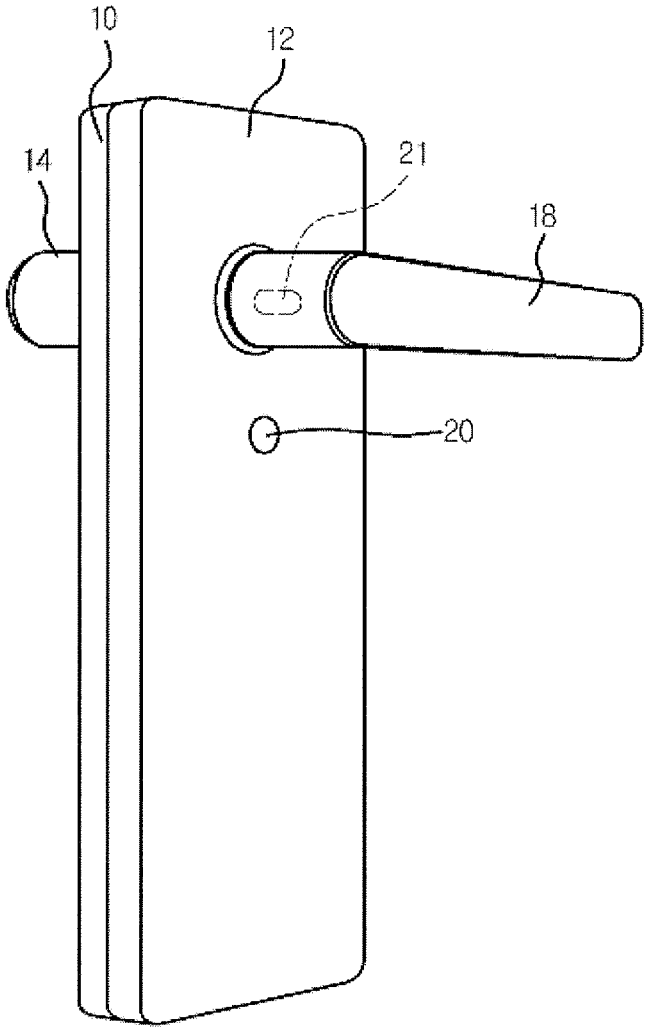
FIG. 2 is a rear view of FIG. 1.
Figure 3:
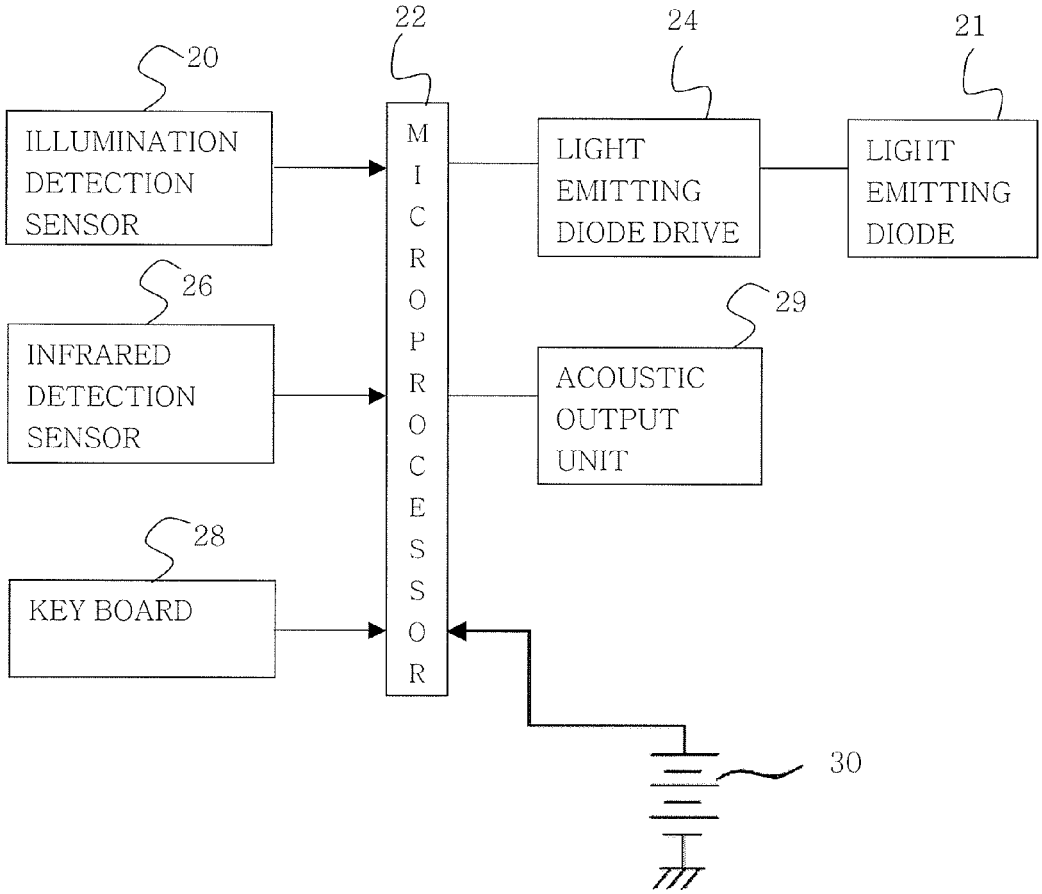
FIG. 3 is a circuit diagram schematically showing a circuit which operates the door lock device according to the first embodiment of the present invention.

As shown in FIGS. 1 through 3, the door lock device according to the first embodiment of the present invention, includes: an outer plate 10 which is installed at the outer side of a door (not shown); an inner plate 12 which is installed at the inner side of the door; an L-shaped outer handle 14 which is protruded at a certain distance from the outer plate and is made of a transparent or semi-transparent material; a key insertion hole 16 which is installed at a certain interval toward the lower portion from the outer handle 14 of the outer plate 10; and an L-shaped inner handle 18 which is protruded at a certain distance from the inner plate 12 and is made of a transparent or semi-transparent material.

The door lock device further includes: an illumination detection sensor 20 which is installed on the inner plate 12 to thus detect an indoor illumination; an infrared detection sensor 26 which is installed on the outer plate so that the key insertion hole 16 can be easily found out at dark or night, to thus detect the infrared radiation from a human body; a microprocessor 22 which receives an illumination detection signal detected by the illumination detection sensor 20, and compares the illumination detection signal with reference illumination data which is pre-stored therein, to thereby output an emitting control signal in the case that it is dark, that is, it is judged that the illumination is low, and simultaneously output an emitting control signal in the case that the infrared radiation from a human body is detected by the infrared detection sensor 26; a light emitting diode drive 24 which receives the emitting control signal from the microprocessor 22 and supplies a light emitting diode 21 with electric power so that the light emitting diode 21 which is installed in one of the inner and outer handles 18 and 14 emits light; a key board 28 which is installed on the outer plate 10 in order to enable a person to input a password or a password change signal into the microprocessor 22; and an acoustic output unit 29 which outputs a melody for notifying that the door lock device is locked when the door lock device is locked, or a melody for notifying that the door lock device is unlocked when the door lock device is unlocked and simultaneously alarming that the door lock device is not locked with a short and quick melody when the door lock device is unlocked.

The light emitting diode 21 is configured to emit mono-colored or multi-colored light.

In FIG. 3, a reference numeral 30 denotes a battery unit which supplies an operating power supply which is necessary for driving the microprocessor 22 and the other elements of the door lock device according to the present invention.

The inner and outer handles 18 and 14 are made of a transparent or semi-transparent high-intensity synthetic resin through which light from the light emitting diodes can be transmitted.

It is preferable that the illumination detection sensor is a photo-cell.

The acoustic output unit 29 is formed of a speaker or a musical box called a Dutch-language orgel which outputs sound mechanically.

Hereinbelow, functions and effects of the door lock device according to the first embodiment of the present invention will be described.

First, a normal locking operation of the door lock device according to the first embodiment of the present invention will be described with respect to a case where a user goes out. If he or she holds the L-shaped inner handle 18 which is protruded at a certain distance from the inner plate 12 and rotates it clockwise, a locking protrusion (not shown) which is combined with a door frame (not shown) backs toward the door lock device according to the first embodiment of the present invention, as in the case of a conventional door lock device. In this case, the door lock device according to the first embodiment of the present invention outputs a soft, long melody sound notifying that the door lock device is unlocked, through the acoustic output unit 29, and simultaneously a light emitting diode 21 which is installed on the inner or outer handle 18 or 14 emits light. Finally, he or she can open the door and go out.

As described above, if the door is shut after he or she has opened the door and gone out, the locking protrusion is protruded toward the door frame. Thus, the door lock device according to the first embodiment of the present invention is locked. Likewise, a soft, long melody sound notifying that the door lock device is locked is output through the acoustic output unit 29, so that he or she can hear that the door lock device is locked. Simultaneously, if predetermined time elapses at the locked state after the light emitting diode 21 which is installed on the inner or outer handle 18 or 14 has emitted light, the light emitting diode 21 is extinguished.

Meanwhile, in the case that the door lock device according to the first embodiment of the present invention has not been normally unlocked although he or she held the inner handle 18 and rotated it clockwise, a short, quick melody sound notifying that the door lock device has not been unlocked is output through the acoustic output unit 29. Accordingly, if he or she holds the inner handle 18 and rotates it clockwise again while pulling the door indoors, the door lock device according to the first embodiment of the present invention can be unlocked. In addition, in the case that the door lock device according to the first embodiment of the present invention is not locked although the door has been shut, a short, quick melody sound notifying that the door lock device has not been locked is repeatedly output through the acoustic output unit 29, otherwise the light emitting diode 21 which is installed on the inner or outer handle 18 or 14 emits light, for example, flickered in red color. Accordingly, if he or she shuts the door again, the door lock device according to the first embodiment of the present invention can be accurately locked.

Meanwhile, if a user gains access to the door lock device according to the first embodiment of the present invention after he or she has gone out and come back, the infrared detection sensor 26 which is installed on the outer plate 10 detects an infrared radiation signal from his or her body and transmits the detected infrared radiation signal to the microprocessor 22. Accordingly, the microprocessor 22 outputs an emitting control signal for the light emitting diode drive 24, and thus the light emitting diode drive 24 supplies the light emitting diode 21 with electric power so that the light emitting diode 21 emits light, that is, the light emitted from the light emitting diode 21 is radiated outdoors.

As the light emitting diode 21 emits the light, a key can be easily inserted into the key insertion hole 16 on the door lock device according to the first embodiment of the present invention. In other words, if a password is input into the key board 28 which is installed on the outer plate 10, in order to unlock the door lock device at the state where the light emitting diode 21 has emitted light, the door lock device is unlocked and a soft, long sound is output from the acoustic output unit 29. Simultaneously, the light emitting diode 21 which is installed on the inner or outer handle 18 or 14 emits light, to thus notify that the door lock device has been unlocked. Then, the outer handle 14 which is protrudingly installed on the outer plate 10 is rotated clockwise, so that the user can open the door and go in.

Meanwhile, if the user inserts the key (not shown) into the key insertion hole 16, and rotates the key in an unlocking direction (for example, clockwise), the locking state of the door lock device is released, that is, the door lock device is unlocked. Likewise, as the locking state of the door lock device is released, a soft, long sound is output from the acoustic output unit 29. Simultaneously, the light emitting diode 21 which is installed on the inner or outer handle 18 or 14 emits light, to thus notify that the door lock device has been unlocked. Then, the outer handle 14 which is protrudingly installed on the outer plate 10 is rotated clockwise, so that the user can open the door and go in.

If the user shuts the door after he or she has gone in, the door lock device according to the first embodiment of the present invention is locked. Then, if predetermined time elapses, the light emitting diode 21 which is installed on the outer handle 14 is extinguished.

In the case that a user inputs an incorrect password into the key board 28, or inserts a falsified key (not shown) into the key insertion hole 16 to then rotate the falsified key clockwise or counterclockwise, a short and quick melody is loudly output from the acoustic output unit 29, to thus notify the user as well as neighbours around the user that the incorrect password has been input into the key board 28, or the falsified key (not shown) has been inserted into the key insertion hole 16 to then rotate the falsified key clockwise or counterclockwise.

If a user turns off all lights in a room, in order to sleep at night, an indoor illumination signal is detected by the illumination detection sensor 20 installed on the inner plate 12. The detected indoor illumination signal is transmitted to the microprocessor 22. The microprocessor 22 compares the illumination detection signal with reference illumination data which is pre-stored therein, to thereby output an emitting control signal to the light emitting diode drive 24, in the case that it is dark, that is, it is judged that the illumination is low. The light emitting diode drive 24 supplies the light emitting diode 21 with electric power so that the light emitting diode 21 which is installed in one of the inner and outer handles 18 and 14 emits light. The inner handle 18 or the outer handle 14 which is made of a transparent or semi-transparent material is illuminated with a certain brightness.

Thus, the door lock device according to the first embodiment of the present invention is installed on a door, so as to enable people to facilitate to find out location of a door at dark or night and enable the light emitting diode 21 to emit light to illuminate the door with a certain brightness so as to be easily viewed at indoor and outdoor sides when indoor and/or outdoor illumination is low, that is, at dark. As a result, the door lock device enables people to easily find out an entrance gate under the fire and other emergency situations. As well, people, particularly persons who have been just awaken from sleep do not need to find out a particular position or particular article gropingly even in a dark indoor or outdoor place. Accordingly, people may not be easily hurt.

Meanwhile, if a user gains access to the door lock device according to the first embodiment of the present invention after he or she has gone out and come back, the infrared detection sensor 26 which is installed on the outer plate 10 detects an infrared radiation signal from his or her body and transmits the detected infrared radiation signal to the microprocessor 22. Accordingly, the microprocessor 22 outputs an emitting control signal for the light emitting diode drive 24, and thus the light emitting diode drive 24 supplies the light emitting diode 21 with electric power so that the light emitting diode 21 which is installed on the inner or outer handle 18 or 14 emits light, that is, the light emitted from the light emitting diode 21 is radiated outdoors.

In this case, since the outer handle 14 is made of a high intensity synthetic resin, and a transparent or semi-transparent material, the light emitted from the light emitting diode 21 is transmitted outwards. As a result, the door lock device according to the first embodiment of the present invention is illuminated with a particular illumination or brightness, so that people can easily find out and see the key board 28 and the key insertion hole 16 which are installed on the outer plate 10.

In addition, in the case of the door lock device according to the first embodiment of the present invention, the door lock device can indicate that people exist in a warehouse or on a roof of a building even in the case that a warehouse door lock device or a roof entrance door lock device has been automatically locked.

In addition, since indoor and outdoor places can be illuminated at a certain brightness, the key board 28 or the key insertion hole 16 can be easily found out by people.

In the above description, the case that an indoor illumination signal is detected by the illumination detection sensor 20, at dark or night, and an emitting control signal output from the microprocessor 22 is transmitted to the light emitting diode drive 24, in the case that it is dark, that is, it is judged that the illumination is low, to thus control the light emitting diode drive 24 to supply the light emitting diode 21 with electric power so that the light emitting diode 21 emits light has been described as an example, but the present invention is not limited thereto. For example, the light emitting diode drive 24 may be configured to be turned on or off manually, so that electric power supplied from the battery unit 30 can be applied to the light emitting diode 21. Of course, this concept of manually supplying the light emitting diode drive 24 with the electric power supplied from the battery unit 30 is included in the technical concept of the present invention.

In the above description, the case that the door lock device where the L-shaped outer handle 14 is protruded on the outer plate 10 and the L-shaped inner handle 18 is protruded on the inner plate 12, has been described as an example, but the present invention is not limited thereto. For example, it is apparent that the present invention can be applied to a cylinder-type door lock device.

On the following, a door lock device according to a second embodiment of the present invention will be described with reference to the accompanying drawings, that is, FIGS. 4 through 6. Like reference numerals are assigned for like elements in the drawings, in comparison with the first embodiment of the present invention.

Figure 4:
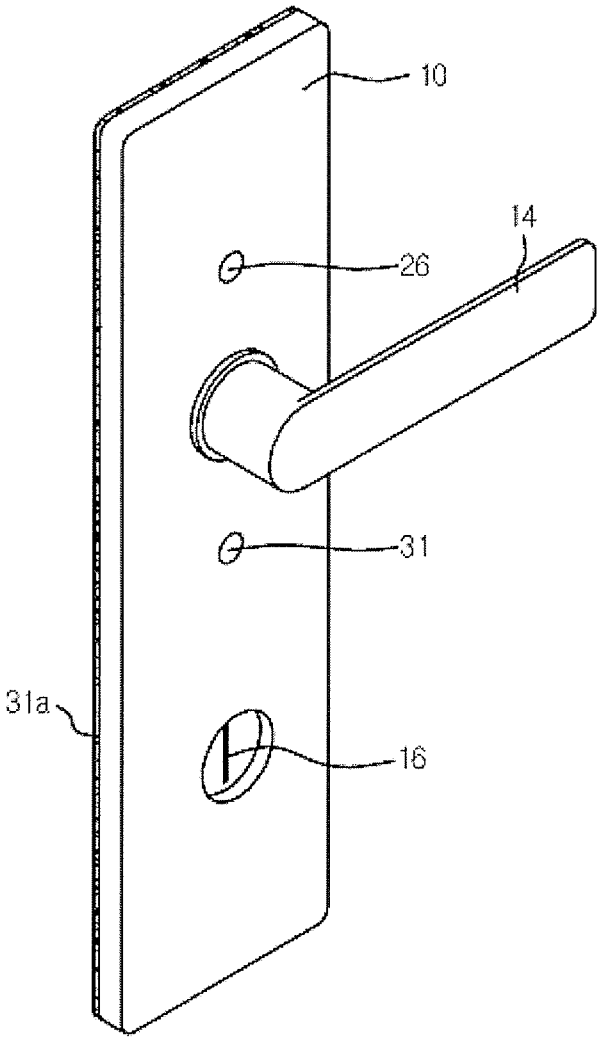
FIG. 4 is a prospective view showing a door lock device when viewed from a front side of the door lock device according to a second embodiment of the present invention.

FIG. 4 is a prospective view showing a door lock device when viewed from a front side of the door lock device according to a second embodiment of the present invention. FIG. 5 is a rear view of FIG. 4. FIG. 6 is a circuit diagram schematically showing a circuit which operates the door lock device according to the second embodiment of the present invention.

When the door lock device according to the second embodiment of the present invention is described, the same portions as those of the respective compositional elements of the door lock device according to the first embodiment of the present invention are assigned with the same reference numerals, and then the detailed description thereof will be omitted to avoid any duplicated description for convenience of explanation.

Figure 5:
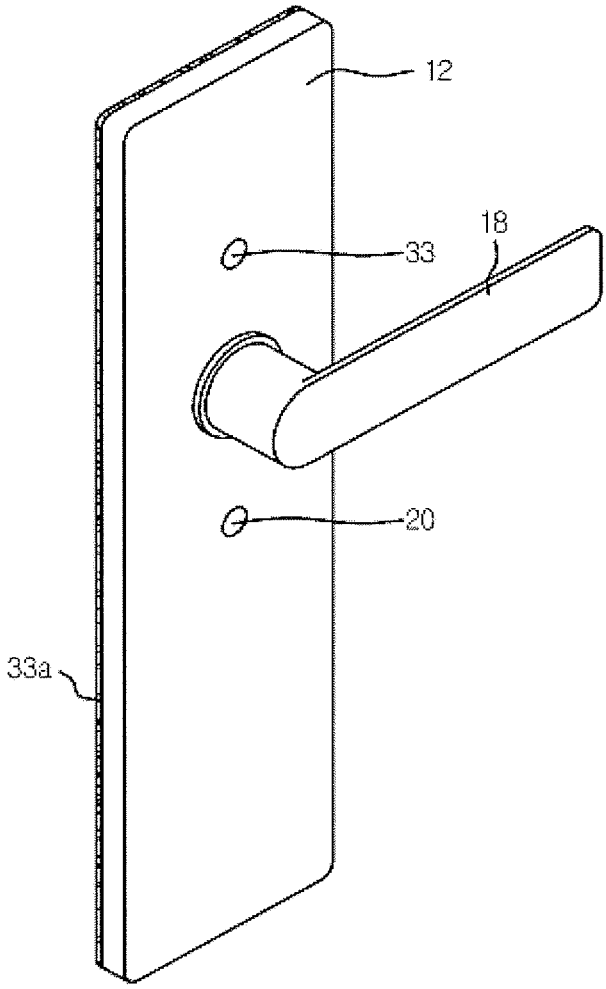
FIG. 5 is a rear view of FIG. 4.
Figure 6:
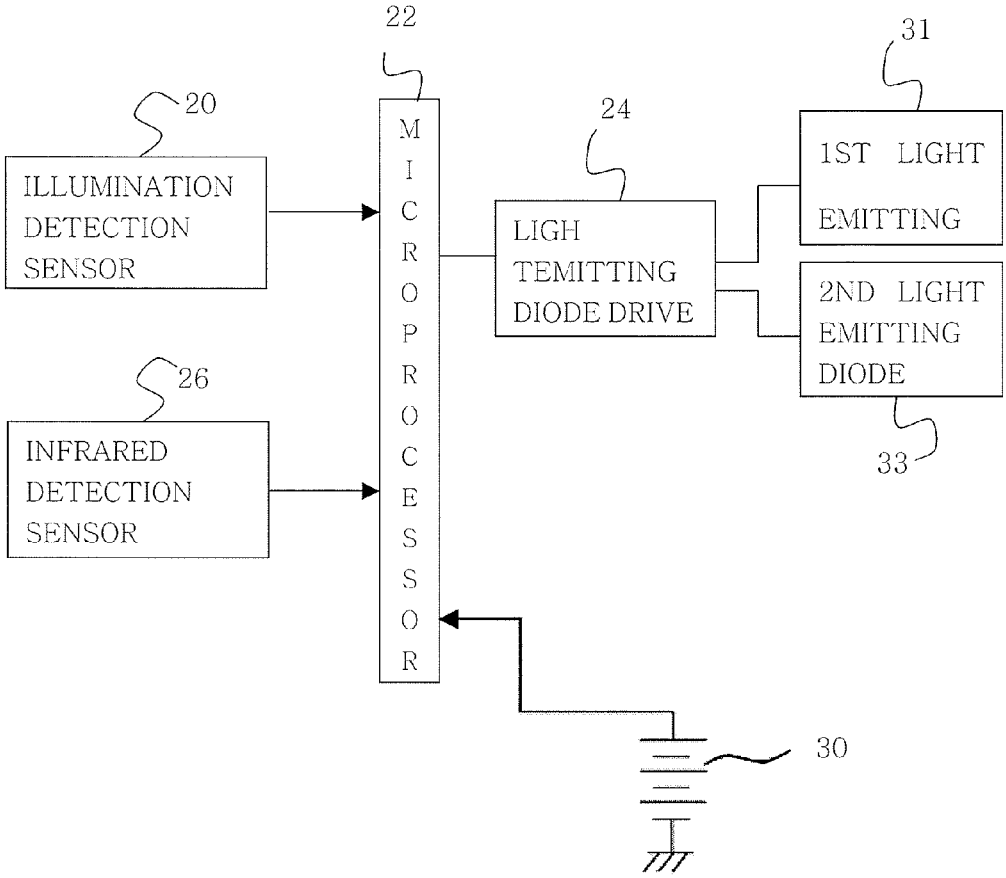
FIG. 6 is a circuit diagram schematically showing a circuit which operates the door lock device according to the second embodiment of the present invention.

As shown in FIGS. 4 through 6, the door lock device according to the second embodiment of the present invention includes: an outer plate 10 which is installed at the outer side of a door (not shown); an inner plate 12 which is installed at the inner side of the door; an L-shaped outer handle 14 which is protruded upwards at a certain distance from the outer plate 10 and is made of a metallic or non-metallic material; a key insertion hole 16 which is installed at a certain interval toward the lower portion from the outer handle 14 of the outer plate 10; and an L-shaped inner handle 18 which is protruded at a certain distance from the inner plate 12 and is made of a metallic or non-metallic material.

The door lock device further includes: an illumination detection sensor 20 which is installed on the inner plate 12 to thus detect an indoor illumination; an infrared detection sensor 26 which is installed on the outer plate 12 so that the key insertion hole 16 can be easily found out at dark or night, to thus detect the infrared radiation from a human body; a microprocessor 22 which receives an illumination detection signal detected by the illumination detection sensor 26, and compares the illumination detection signal with reference illumination data which is pre-stored therein, to thereby output an emitting control signal in the case that it is dark, that is, it is judged that the illumination is low, and simultaneously output an emitting control signal in the case that the infrared radiation from a human body is detected by the infrared detection sensor 26; a light emitting diode drive 24 which receives the emitting control signal from the microprocessor 22 and supplies first and second light emitting diodes 31 and 33 with electric power so that one of the first and second light emitting diodes 31 and 33 which are, respectively installed in the inner and outer plates 10 and 12 emits light; a first light guide 31*a* which is installed on the rear surface of the outer plate 10 and which is made of a transparent or semi-transparent high-intensity synthetic resin or crystal material, so that light emitted from the first light emitting diode 31 is radiated outdoors; and a second light guide 33*a* which is installed on the rear surface of the inner plate 12 and which is made of a transparent or semi-transparent high-intensity synthetic resin or crystal material, so that light emitted from the second light emitting diode 33 is radiated indoors.

Hereinbelow, functions and effects of the door lock device according to the second embodiment of the present invention will be described.

First, a normal locking operation of the door lock device according to the second embodiment of the present invention will be described with respect to a case where a user goes out. If he or she holds the L-shaped inner handle 18 which is protruded at a certain distance from the inner plate 12 and rotates it clockwise, a locking protrusion (not shown) which is combined with a door frame (not shown) backs toward the door lock device according to the second embodiment of the present invention, as in the case of a conventional door lock device. In this case, the door lock device according to the second embodiment of the present invention is unlocked, and simultaneously first and second light emitting diodes 31 and 33 which are respectively installed in the inner and outer plates 10 and 12 emit light, respectively, so that the light emitted from the first and second light emitting diodes 31 and 33 are radiated outwards through first and second light guides 31*a* and 33*a*, respectively. Finally, he or she can open the door and go out.

As described above, if the door is shut after he or she has opened the door and gone out, the locking protrusion (not shown) is protruded toward the door frame. Thus, the door lock device according to the second embodiment of the present invention is locked, and then if predetermined time elapses, the first and second light emitting diodes 21 are extinguished.

Meanwhile, if a user gains access to the door lock device according to the second embodiment of the present invention after he or she has gone out and come back, the infrared detection sensor 26 which is installed on the outer plate 10 detects an infrared radiation signal from his or her body and transmits the detected infrared radiation signal to the microprocessor 22.

Accordingly, the microprocessor 22 outputs an emitting control signal for the light emitting diode drive 24, and thus the light emitting diode drive 24 supplies the first light emitting diode 31 with electric power so that the light emitting diode 31 emits light. Then, the light emitted from the first light emitting diode 31 is radiated outdoors through the first light guide 31*a*.

As the first light emitting diode 21 emits the light, a key can be easily inserted into the key insertion hole 16 on the door lock device according to the second embodiment of the present invention. In other words, if the key is inserted into the key insertion hole 16 and then the inserted key is rotated clockwise or counterclockwise, in order to unlock the door lock device at the state where the first light emitting diode 31 has emitted light, the door lock device is unlocked. Then, the outer handle 14 which is protrudingly installed on the outer plate 10 is rotated clockwise, so that the user can open the door and go in.

If the user shuts the door after he or she has gone in, the door lock device according to the second embodiment of the present invention is locked. Then, if predetermined time elapses, the first light emitting diode 31 which is installed on the outer plate 10 is extinguished.

If a user turns off all lights in a room, in order to sleep at night, an indoor illumination signal is detected by the illumination detection sensor 20 installed on the inner plate 12. The detected indoor illumination signal is transmitted to the microprocessor 22. The microprocessor 22 compares the illumination detection signal with reference illumination data which is pre-stored therein, to thereby output an emitting control signal to the light emitting diode drive 24, in the case that it is dark, that is, it is judged that the illumination is low. The light emitting diode drive 24 supplies the second light emitting diode 33 which is installed in the inner plate 12 with electric power so that the second light emitting diode 33 emits light. The light emitted from the second light emitting diode 33 is radiated indoors through the second light guide 33*a*, to thereby illuminate indoors with a certain brightness.

In addition, in the case of the door lock device according to the second embodiment of the present invention, the door lock device can indicate that people exist in a warehouse or on a roof of a building even in the case that a warehouse door lock device or a roof entrance door lock device has been automatically locked. In addition, since indoor and outdoor places can be illuminated at a certain brightness, the key insertion hole 16 can be easily found out by people even at dark or night.

In the above description, the case that an indoor illumination signal is detected by the illumination detection sensor 20, at dark or night, and an emitting control signal output from the microprocessor 22 is transmitted to the light emitting diode drive 24, in the case that it is dark, that is, it is judged that the illumination is low, to thus control the light emitting diode drive 24 to supply the light emitting diodes 31 and 33 with electric power so that the light emitting diodes 31 and 33 emit light has been described as an example, but the present invention is not limited thereto. For example, the light emitting diode drive 24 may be configured to be turned on or off manually, so that electric power supplied from the battery unit 30 can be applied to the light emitting diodes 31 and 33. Of course, this concept of manually supplying the light emitting diode drive 24 with the electric power supplied from the battery unit 30 is included in the technical concept of the present invention.

On the following, a door lock device according to a third embodiment of the present invention will be described with reference to the accompanying drawings, that is, FIGS. 7 and 8. Like reference numerals are assigned for like elements in the drawings, in comparison with the first and second embodiments of the present invention.

Figure 7:
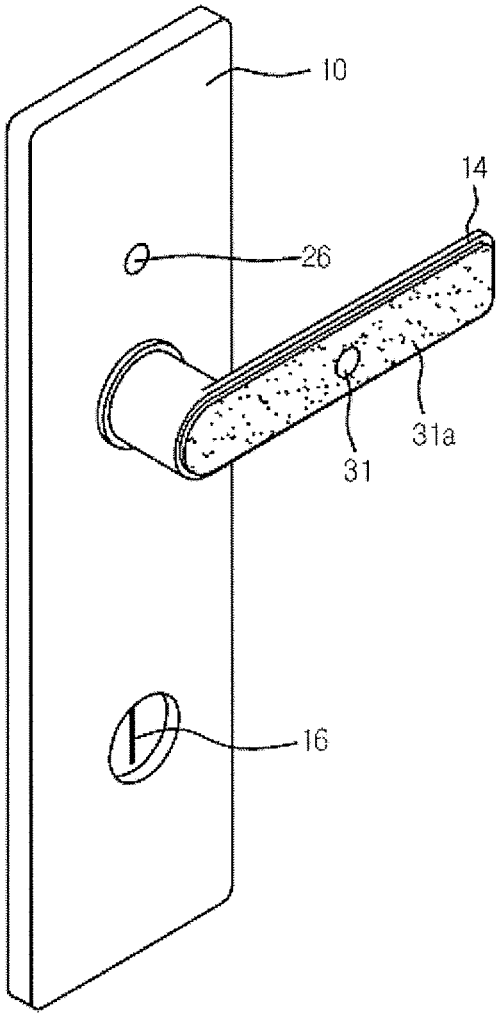
FIG. 7 is a prospective view showing a door lock device when viewed from a front side of the door lock device according to a third embodiment of the present invention.
Figure 8:
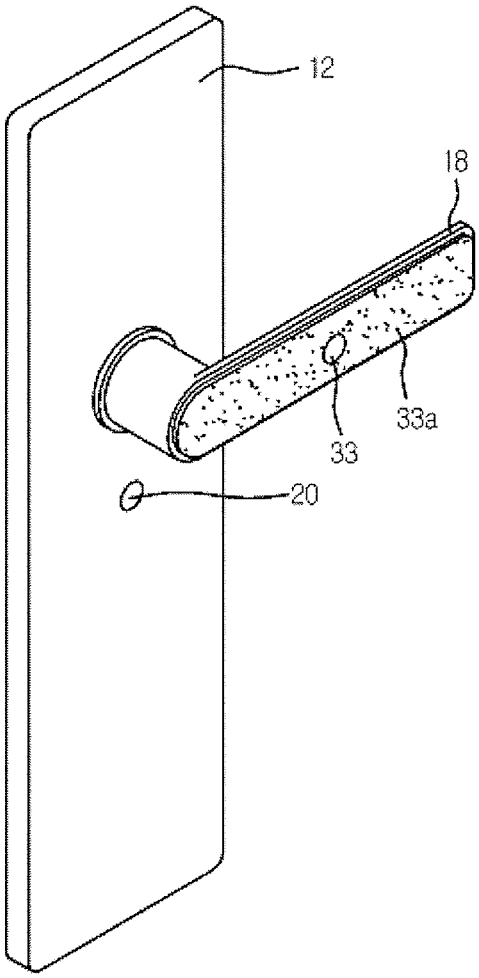
FIG. 8 is a rear view of FIG. 7.

FIG. 7 is a prospective view showing a door lock device when viewed from a front side of the door lock device according to a third embodiment of the present invention and FIG. 8 is a rear view of FIG. 7.

The door lock device according to the third embodiment of the present invention differs from the door lock device according to the second embodiment of the present invention, in view of places where first and second light emitting diodes 31 and 33 and first and second light guides 31*a* and 33*a* are installed. That is, as shown in FIGS. 7 and 8, the first light emitting diode 31 is installed on the outer handle 14 and the first light guide 31*a* is installed on the front surface of the outer handle 14, and the second light emitting diode 33 is installed on the inner handle 18 and the second light guide 33*a* is installed on the front surface of the inner handle 18, in the case of the third embodiment of the present invention.

Besides, since functions and effects of the door lock device according to the third embodiment of the present invention are identical with those of the second embodiment of the present invention, the detailed description thereof will be omitted.

As described above, a door lock device according to the present invention is installed on a door, to thus enable people to facilitate to find out location of the door at dark or night and enable the door to be illuminated with a certain brightness so as to be easily viewed at indoor and outdoor sides when indoor and/or outdoor illumination is low, that is, at dark.

As a result, the door lock device according to the present invention enables people to easily find out an entrance gate under the fire and other emergency situations. As well, people do not need to find out a particular position or particular article gropingly even in a dark indoor or outdoor place. Accordingly, people may not be easily hurt.

In addition, in the case of the door lock device according to the present invention, since indoor and outdoor places can be illuminated at a certain brightness, the door lock device can indicate that people exist in a warehouse or on a roof of a building even in the case that a warehouse door lock device or a roof entrance door lock device has been automatically locked.

Further, the door lock device according to the present invention enables people to easily find out a key board and/or a key insertion hole at night.

Still further, the door lock device according to the present invention enables people to easily identify a state whether or not a door is locked by means of an acoustic melody output or emission of light emitting diodes.

The present invention is not limited to the above-described embodiments. It is apparent to one who has an ordinary skill in the art that there may be many modifications and variations within the same technical spirit of the invention.

What is claimed is:

1. A door lock device comprising:

an outer plate which is installed at the outer side of a door;

an inner plate which is installed at the inner side of the door;

an L-shaped outer handle which is protruded at a certain distance from the outer plate;

a key insertion hole which is installed at a certain interval toward the lower portion from the outer handle of the outer plate; and an L-shaped inner handle which is protruded at a certain distance from the inner plate, wherein the door lock device further consists of:

an illumination detection sensor which is installed on only the inner plate to thus detect an indoor illumination;

an infrared detection sensor which is installed on only the outer plate to thus detect the infrared radiation from a human body;

a microprocessor which receives an illumination detection signal detected by the illumination detection sensor, and compares the illumination detection signal with reference illumination data which is pre-stored therein, to thereby output a first emitting control signal in the case that it is judged that the detected illumination is lower than reference illumination, and output a second emitting control signal in the case that the infrared radiation from a human body is detected by the infrared detection sensor;

a light emitting diode which is installed in one of the inner and outer handles;

a light emitting diode drive which receives at least one of the first and second emitting control signals from the microprocessor and supplies the light emitting diode with electric power so that the light emitting diode emits light;

a key board which is installed on the outer plate in order to enable a person to input a password or a password change signal into the microprocessor; and an acoustic output unit which outputs a melody for notifying that the door lock device has been locked or unlocked and outputs an alarm melody for alarming that the door lock device has not been unlocked if the door lock device has been locked although the L-shaped inner handle or the L-shaped outer handle has been turned toward a door opening direction, or alarming that the door lock device has not been locked if the door lock device has been unlocked although the L-shaped inner handle or the L-shaped outer handle has been turned toward a door closing direction, wherein the inner and outer handles are made of a transparent or semi-transparent high-intensity synthetic resin through which light from the light emitting diode can be transmitted, and wherein the light emitting diode is turned off if a predetermined time elapses, in the case that it is judged that the detected illumination is higher than reference illumination, and the light emitting diode is turned on continuously, in the case that it is judged that the detected illumination is equal to or lower than reference illumination.

2. The door lock device according to claim 1, wherein the illumination detection sensor is a photo-cell.

3. A door lock device comprising:

an outer plate which is installed at the outer side of a door;

an inner plate which is installed at the inner side of the door;

an L-shaped outer handle which is protruded upwards at a certain distance from the outer plate and is made of a metallic or non-metallic material;

a key insertion hole which is installed at a certain interval toward the lower portion from the outer handle of the outer plate; and an L-shaped inner handle which is protruded at a certain distance from the inner plate and is made of a metallic or non-metallic material;

wherein the door lock device further consists of:

an illumination detection sensor which is installed on only the inner plate to thus detect an indoor illumination;

an infrared detection sensor which is installed on only the outer plate to thus detect the infrared radiation from a human body;

a microprocessor which receives an illumination detection signal detected by the illumination detection sensor, and compares the illumination detection signal with reference illumination data which is pre-stored therein, to thereby output a first emitting control signal in the case that it is judged that the detected illumination is lower than reference illumination, and output a second emitting control signal in the case that the infrared radiation from a human body is detected by the infrared detection sensor;

first and second light emitting diodes which are respectively incorporated in the inner and outer plates;

a light emitting diode drive which receives at least one of the first and second emitting control signals from the microprocessor and supplies at least one of the first and second light emitting diodes with electric power so that one of the first and second light emitting diodes emits light;

a first light guide which is installed on the rear surface of the outer plate so that light emitted from the first light emitting diode is radiated outdoors; and a second light guide which is installed on the rear surface of the inner plate so that light emitted from the second light emitting diode is radiated indoors, wherein the first and second light guides are made of a transparent or semi-transparent high-intensity synthetic resin or crystal material, and wherein at least one of the light emitting diodes is turned off if a predetermined time elapses, in the case that it is judged that the detected illumination is higher than reference illumination, and at least one of the light emitting diodes is turned on continuously, in the case that it is judged that the detected illumination is equal to or lower than reference illumination.

* * * * *